US012157925B2

(12) United States Patent
Ghassemi-Armaki et al.

(10) Patent No.: US 12,157,925 B2
(45) Date of Patent: Dec. 3, 2024

(54) METHOD OF MANUFACTURING MARTENSITIC STEEL AND A MARTENSITIC STEEL THEREOF

(71) Applicant: ArcelorMittal, Luxembourg (LU)

(72) Inventors: Hassan Ghassemi-Armaki, Schererville, IN (US); Vikas Kanubhai Patel, Naperville, IL (US); Timothy Gustafson, Valparaiso, IN (US)

(73) Assignee: ArcelorMittal, Luxembourg (LU)

( * ) Notice: Subject to any disclaimer, the term of this patent is extended or adjusted under 35 U.S.C. 154(b) by 591 days.

(21) Appl. No.: 17/291,973

(22) PCT Filed: Nov. 15, 2019

(86) PCT No.: PCT/IB2019/059833

§ 371 (c)(1),
(2) Date: May 6, 2021

(87) PCT Pub. No.: WO2020/109918

PCT Pub. Date: Jun. 4, 2020

(65) Prior Publication Data

US 2021/0404032 A1 Dec. 30, 2021

(30) Foreign Application Priority Data

Nov. 30, 2018 (WO) ..... PCT/IB2018/059513

(51) Int. Cl.
*C21D 9/50* (2006.01)
*B21B 15/00* (2006.01)
(Continued)

(52) U.S. Cl.
CPC ..... *C21D 9/505* (2013.01); *B21B 15/0085* (2013.01); *C21D 1/26* (2013.01);
(Continued)

(58) Field of Classification Search
CPC ..... B21B 15/0085; B21B 2015/0092; C21D 1/26; C21D 2211/001; C21D 2211/002;
(Continued)

(56) References Cited

U.S. PATENT DOCUMENTS 8,803,023 B2 8/2014 Agashe et al.
2015/0267281 A1 9/2015 Song et al.

FOREIGN PATENT DOCUMENTS

CN 101041879 A 9/2007
CN 103334057 A 10/2013
(Continued)

OTHER PUBLICATIONS

See Search Report of PCT/IB2019/059833 dated Feb. 19, 2020 and Written Opinion.

*Primary Examiner* — Jenny R Wu
(74) *Attorney, Agent, or Firm* — Davidson Kappel LLC

(57) ABSTRACT

A martensitic steel including the following elements, expressed in percentage by weight 0.1%≤C≤0.4%; 0.2%≤Mn≤2%; 0.4%≤Si≤2%; 0.2%≤Cr≤1%; 0.01%≤Al≤1%; 0%≤S≤0.09%; 0%≤P≤0.09%; 0%≤N≤0.09%; and can contain one or more of the following optional elements 0%≤Ni≤1%; 0%≤Cu≤1%; 0%≤Mo≤0.1%; 0%≤Nb≤0.1%; 0%≤Ti≤0.1%; 0%≤V≤0.1%; 0.0015%≤B≤0.005%; 0%≤Sn≤0.1%; 0%≤Pb≤0.1%; 0%≤Sb≤0.1%; 0%≤Ca≤0.1%; the remainder composition being composed of iron and unavoidable impurities caused by processing, the microstructure of said steel having microstructure by area percentage including cumulative presence of residual austenite and bainite between 0% and 25%, the remaining microstructure being martensite at least 70%, and with an optional presence of ferrite between 0% and 10%.

19 Claims, 4 Drawing Sheets

(51) Int. Cl.

| | |
|---|---|
| ***C21D 1/26*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 6/002* (2013.01); *C21D 6/005* (2013.01); *C21D 6/008* (2013.01); *C21D 8/0205* (2013.01); *C21D 8/0247* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *B21B 2015/0092* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 2211/005; C21D 2211/008; C21D 2221/01; C21D 2251/04; C21D 6/002; C21D 6/005; C21D 6/008; C21D 8/02; C21D 8/0205; C21D 8/0247; C21D 8/04; C21D 8/0405; C21D 9/46; C21D 9/50; C21D 9/505; C22C 38/001; C22C 38/002; C22C 38/02; C22C 38/04; C22C 38/06; C22C 38/26; C22C 38/28; C22C 38/32; C22C 38/58; C22C 38/60; B21C 47/02

See application file for complete search history.

(56) References Cited

FOREIGN PATENT DOCUMENTS

| | | | | |
|---|---|---|---|---|
| CN | 105899320 | A | 8/2016 | |
| EP | 2130620 | A1 * | 12/2009 | ..... B21C 47/247 |
| JP | S60216994 | A | 10/1985 | |
| JP | 2014226720 | A | 12/2014 | |
| JP | 2017503072 | A | 1/2017 | |
| JP | 2019014937 | A | 1/2019 | |
| WO | WO 2015088514 | A1 | 6/2015 | |

* cited by examiner

METHOD OF MANUFACTURING MARTENSITIC STEEL AND A MARTENSITIC STEEL THEREOF

The present invention relates to a method of continuous manufacturing of martensitic steel suitable to be processed in a continuous annealing line particularly to Martensitic steels having tensile strength 1500 MPa or more.

BACKGROUND

Cold rolled steel sheets are processed continuously in continuous galvanizing, continuous annealing, and other heat treatment processing lines of cold rolling mills. In order to optimize the efficiency of the heat treatment processes such as annealing and galvanizing the steel sheets are joined end to end via lap-seam welding. Specifically, the tail or trailing end of a preceding (first) coil and the head end of an incoming (second) coil are joined together at the entry end of the mill, thereby creating a continuous joined sheet that may be processed continuously in the mill at a much higher efficiency than would be realized if the sheets were individually processed.

A conventional lap-seam or mash-seam welder may be used effectively for welding low carbon and high strength low alloy ("HSLA") grade steel. The weld is formed in a single pass, in which a welding device, such as a pair of opposing electrodes mounted on a carriage, moves along overlapping portions of the HSLA grade steel to form a weld, before returning to its home position in idle mode.

SUMMARY OF THE INVENTION

Advanced high strength steels (AHSS) especially the martensitic steels have a tensile strength greater than that of HSLA grade steel or low carbon grades. Martensitic steels are characterized by their high carbon equivalent, high tensile strength, and high electrical resistivity. This high tensile strength is specifically beneficial for the automobile industry, for example, the use of martensitic steels and their heightened tensile strengths in a vehicle frame permits the production of automotive components with reduced weight and accompanying fuel efficiency improvements without adversely affecting the safety of the vehicle. But due the high carbon content the martensitic steels specifically cannot be processed continuously through the conventional seam welding process as these welding process when employed for two high carbon steels without a preheat results in a brittle and weak weld due to the fact that the solidified and cooled melt zone of high carbon steel consists of relatively hard and brittle high carbon martensite and also the oxide formation. This brittle and hard microstructure develop cracks either instantly after welding or when process inside the continuous annealing, pickling or galvanizing line. Further, very high alloy content especially the high carbon content and high resistivity of AHSS makes these grades ultra-sensitive to welding parameters.

Hence the need to replace the high carbon steel to high carbon steel weld is necessitated for the safe and reliable processing through the mill for high carbon steels because failure of the weld during continuous annealing or any other continuous heat treatment process may cause a shut down of the processing route of a complete continuous cold rolling mill for relatively short (e.g., 1 hour) or extended (e.g., 1 day) periods, depending on the location and severity of the weld break.

Earlier research and developments in the field of continuous processing of AHSS have resulted in several methods for producing AHSS continuously such as the application of induction heating after welding. This alternative solution requires the installation of an induction heating unit or separate station requiring capital investment and significant additional processing time to cool down the weld. Hence the solution is not suitable for continuous heat treatment routes of a cold rolling mills.

Further a granted U.S. Pat. No. 8,803,023 also suggests a mechanism of welding by proposing two welding passes for AHSS steels. But the patent does not demonstrate the welding of steels having tensile strength greater than 1700 MPa.

It is an object of the present invention to provide a method processing AHSS specifically Martensitic steels in continuous annealing to manufacture a steel having tensile strength greater than 1500 MPa to use in manufacturing automobiles, the method allowing the non-heat treated steel of AHSS specifically Martensitic steels being heat treated by a continuous heat treatment process.

The present invention provides a method and composite coil of steel suitable to be used in continuous heat treatment processing lines to produce a martensitic steel sheet to be used in automobile that simultaneously have:

- an ultimate tensile strength greater than or equal to 1500 MPa and preferably above 1700 MPa and more preferably above 1900 MPa,
- a yield strength greater than or equal to 1200 MPa and preferably above 1400 MPa Another object of the present invention is also to make available a method for the manufacturing of these sheets that is compatible with conventional industrial applications while being robust towards manufacturing parameters shifts.

The composite coil of steel of the present invention may optionally be coated with zinc or zinc alloys, or with aluminum or aluminum alloys to improve its corrosion resistance.

The present invention remedies the problem by manufacturing an intermediate product which is a composite coil which is manufactured by welding a low carbon steel or HSLA grade steel hereinafter referred as a stringer steel piece along both the width of the non-heat treated cold rolled steel sheet of AHSS steel and specifically martensitic steel, so that the AHSS-to-AHSS weld is replaced by stronger and more reliable HSLA-to-HSLA welds for indirectly joining the AHSS coils together for a continuous heat treatment process such as annealing or galvanization.

The composite coil of the present invention must have weld bendability of greater than or equal to 12 bending cycles so that it can act as an input to the continuous annealing line or any other heat treatment process.

The composite coil of the present invention must have a weld toughness of more than 70% so that the composite coil can with stand the fluctuation of a continuous heat treatment process.

Preferably, such composite coil of steel is suitable for manufacturing of cold rolled sheets to be used for automobiles.

Preferably, such composite coil of steel can also have a good suitability for forming, in particular for rolling with good weldability and coatability.

DETAILED DESCRIPTION

Figure 1:
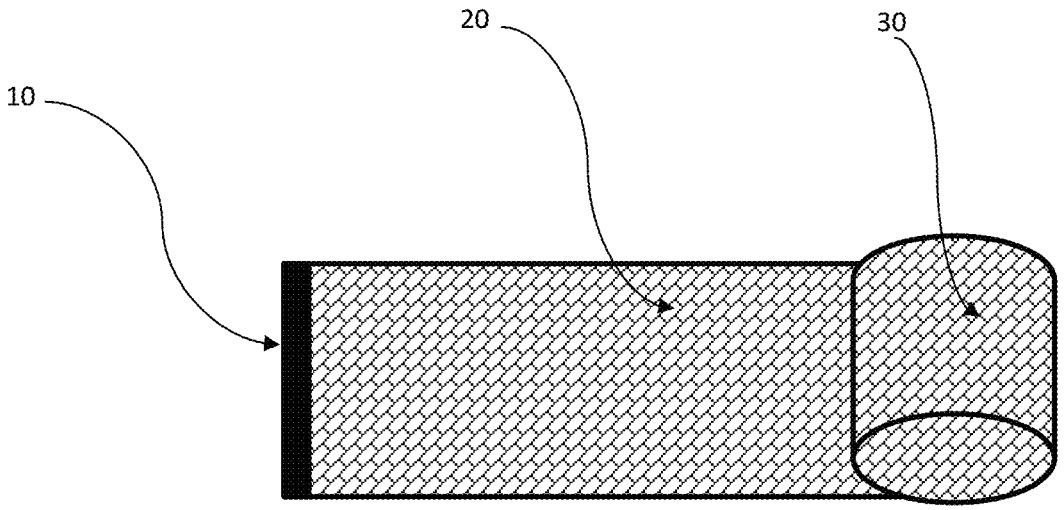
FIG. 1 shows the prepared end of the de-coiled outer windings of the cold rolled steel sheet, the de-coiled first two outer windings of the cold rolled steel sheet and the remaining coil cold rolled steel sheet.

The method is specifically explained herein for the appreciation of the invention. A martensitic steel according to the invention can be produced by the method of successive steps mentioned herein.

A preferred method consists in providing a semi-finished casting of steel with a chemical composition of the prime steel according to the invention. The casting can be done either into ingots or continuously in form of thin slabs or thin strips, i.e. with a thickness ranging from approximately 220 mm for slabs up to several tens of millimeters for thin strip.

For example, a slab having the chemical composition of the prime steel is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling.

The temperature of the slab, which is subjected to hot rolling, is preferably at least 1000° C. and must be below 1280° C. In case the temperature of the slab is lower than 1150° C., excessive load is imposed on a rolling mill and, further, the temperature of the steel may decrease to a Ferrite transformation temperature during finishing rolling, whereby the steel will be rolled in a state in which transformed Ferrite is contained in the structure. Therefore, the temperature of the slab is preferably sufficiently high so that hot rolling can be completed in the temperature range of Ac3 to Ac3+100° C. and final rolling temperature remains above Ac3. Reheating at temperatures above 1280° C. must be avoided because they are industrially expensive.

A final rolling temperature range between Ac3 to Ac3+100° C. is preferred to have a structure that is favorable to recrystallization and rolling. It is necessary to have a final rolling pass to be performed at a temperature greater than 850° C., because below this temperature the steel sheet exhibits a significant drop in rollability. The sheet obtained in this manner is then cooled at a cooling rate above 30° C./s to the coiling temperature which must be between 475° C. and 650° C. Preferably, the cooling rate will be less than or equal to 200° C./s.

The hot rolled steel sheet is then coiled at a coiling temperature between 475° C. and 650° C. to avoid ovalization and preferably below 625° C. to avoid scale formation. The preferred range for such coiling temperature is between 500° C. and 625° C. The coiled hot rolled steel sheet is cooled down to room temperature before subjecting it to optional hot band annealing.

The hot rolled steel sheet may be subjected to an optional scale removal step to remove the scale formed during the hot rolling before optional hot band annealing. The hot rolled sheet may then have subjected to an optional Hot Band Annealing at temperatures between 400° C. and 750° C. for at least 12 hours and not more than 96 hours, the temperature remaining below 750° C. to avoid transforming partially the hot-rolled microstructure and, therefore, losing the microstructure homogeneity. Thereafter, an optional scale removal step of this hot rolled steel sheet may performed through, for example, pickling of such sheet. This hot rolled steel sheet is subjected to cold rolling to obtain a cold rolled steel sheet with a thickness reduction between 35 to 90%. The cold rolled steel sheet is then obtained. This non heat treated cold rolled steel sheet is also referred to herein as Prime steel.

Thereafter the method includes providing at least two stringers consisting of any steel having a carbon content between 0.001 and 0.25% or less. Stringers for the present invention are steel pieces of identical width and of thickness same as of the cold rolled steel sheet and can vary in length as per the requirement of the invention. Stringer steel of the present invention must always contain carbon content between 0.001% and 0.25% and preferably 0.001% and 0.20%. Two stringers provided are referred as Stringer one and Stringer two herein.

Then the method includes de-coiling at least the first two outer windings of the cold rolled steel sheet then prepare the leading end of the de-coiled windings of cold rolled steel sheet for welding. A figurative representation is shown in FIG. 1 wherein the 10 shows the prepared end of the de-coiled outer windings of the cold rolled steel sheet and 20 shows the de-coiled first two outer windings of the cold rolled steel sheet and numeral 30 designates the remaining coil cold rolled steel sheet.

Figure 2:
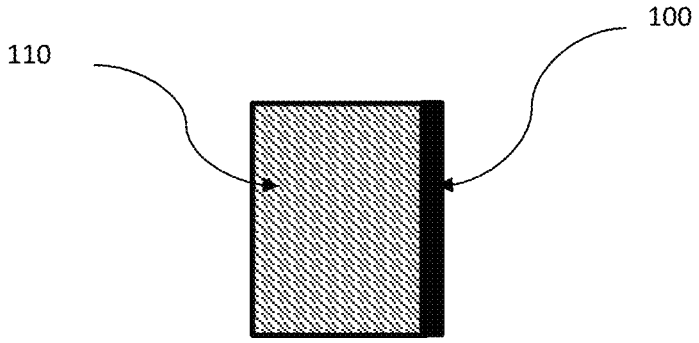
FIG. 2 shows Stringer one.

The method includes preparing any one of the end widths of Stringer one for welding. FIG. 2 shows a prepared width 100 of a stringer and 110 as stringer one. Thereafter the method includes welding the prepared width of stringer one to the prepared end of the cold rolled steel sheet to obtain a welded cold rolled steel sheet.

Figure 3:
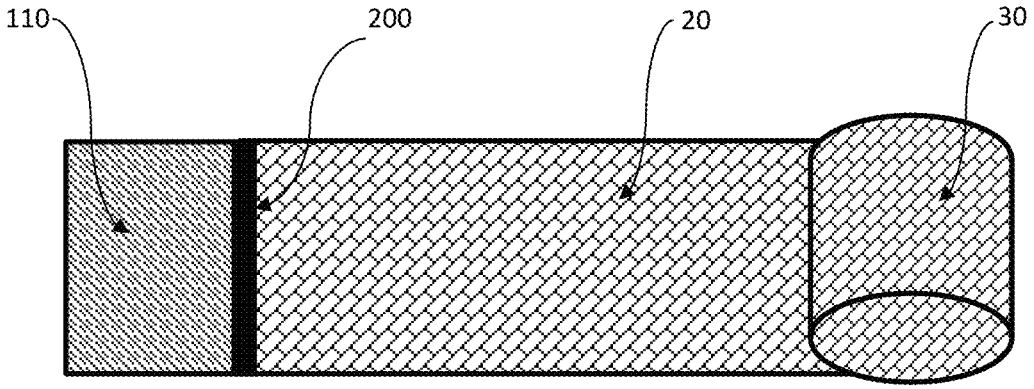
FIG. 3 shows a welded end of the cold rolled steel sheet with the stringer.

A welded end of the cold rolled steel sheet with the stringer is shown FIG. 3 wherein 200 is the weld and 110 is the stringer and 20 shows the two outer windings of the cold rolled steel sheet and 30 shows the remaining coiled cold rolled steel sheet.

Then the method includes spooling-back the welded cold rolled steel sheet to bring the un-welded end as outer windings. The non-welded end of the welded-cold rolled steel sheet are brought as outer windings and then at least the first two outer windings are decoiled and the method then includes preparing the de-coiled non-welded end of the welded cold rolled steel sheet for welding.

Figure 4:
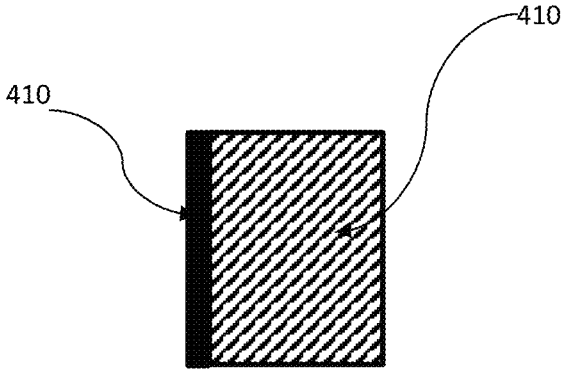
FIG. 4 shows Stringer two.
Figure 5:
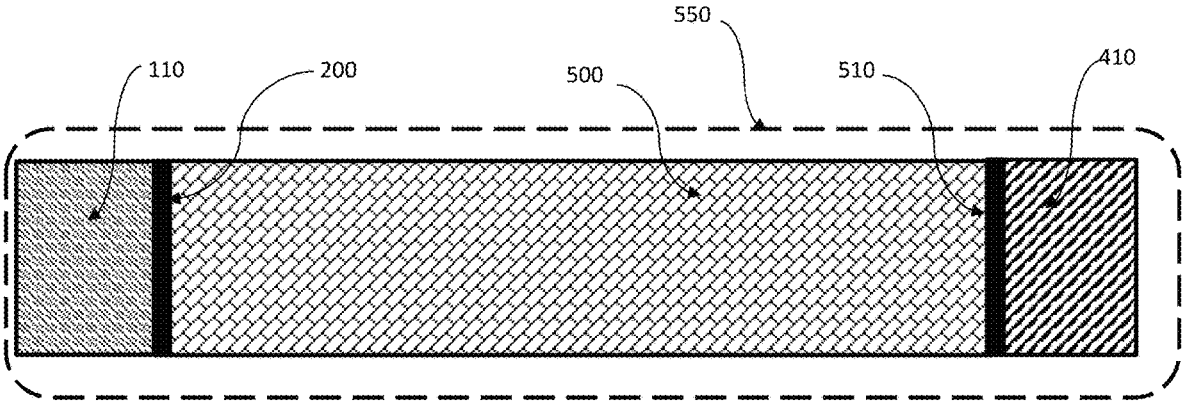
FIG. 5 shows the schematic view of a flat composite coil denoted as whole.

The method includes preparing any of the end widths of stringer two for welding as shown in FIG. 4 wherein the prepared end is mentioned as 400 and the stringer two is shown as 410. Then the method includes welding the prepared width of stringer two to the prepared end of the welded cold rolled steel sheet to obtain the composite steel sheet FIG. 5 shows the schematic view of a flat composite coil denoted as whole as 550 wherein 500 is the flat de-coiled cold rolled steel sheet and 110 is the stringer one, 410 is the stringer two, 200 denotes the weld between the stringer one and the cold rolled steel sheet and 510 denotes the weld between the stringer two and the welded cold rolled steel sheet.

Thereafter the composite coil is sent to continuous annealing cycle for heat treatment which will impart the steel of present invention with requisite mechanical properties and microstructure as well as put to test the welds for their bendability and toughness of the composite coil.

In annealing of the composite steel sheet, the composite steel sheet is heated at a heating rate which is greater than 2° C./s and preferably greater than 3° C./s, to a soaking temperature between Ac3 and Ac3+100° C. wherein Ac3 for the composite steel sheet is calculated by using the following formula:

$$Ac3=901-262*C-29*Mn+31*Si-12*Cr-155*Nb+86*Al$$

wherein the elements contents are expressed in weight percentage of the cold rolled steel sheet.

The composite steel sheet is held at the soaking temperature during 10 seconds to 500 seconds to ensure a complete recrystallization and full transformation to Austenite of the strongly work hardened initial structure. The composite steel sheet is then cooled at a cooling rate greater than 25° C./s to a temperature less than Ms temperature and preferably less than 400° C. and holding the composite steel sheet during 10 seconds to 1000 seconds to between the temperature range 150° C. and 400° C. to impart the requisite microstructure to the present invention, then cool the composite steel sheet to room temperature to obtain a cooled composite steel sheet.

Thereafter the method includes performing shear-cropping operation to remove the stringer one and stringer two to the martensitic steel sheet.

The chemical composition of the martensitic steel sheet to be used in the method of manufacturing the martensitic steel is as follows:

Carbon is present in the composite coil of steel between 0.10% and 0.4%. Carbon is an element necessary for increasing the strength of the Steel of present invention by producing a low-temperature transformation phases such as Martensite, further Carbon also plays a pivotal role in Austenite stabilization, hence, it is a necessary element for securing Residual Austenite. Therefore, Carbon plays two pivotal roles, one is to increase the strength and another in Retaining Austenite to impart ductility. But Carbon content less than 0.10% will not be able to stabilize Austenite in an adequate amount required by the steel of present invention. On the other hand, at a Carbon content exceeding 0.4%, the steel exhibits poor spot weldability, which limits its application for the automotive parts.

Manganese content of the composite coil of steel of present invention is between 0.2% and 2%. This element is gammagenous. The purpose of adding Manganese is essentially to obtain a structure that contains Austenite. Manganese is an element which stabilizes Austenite at room temperature to obtain Residual Austenite. An amount of at least about 0.2% by weight of Manganese is mandatory to provide the strength and hardenability to the Steel of the present invention as well as to stabilize Austenite. Thus, a higher percentage of Manganese is preferred such as 2%. But when Manganese content is more than 2% it produces adverse effects such as it retards transformation of Austenite to Bainite during cooling after annealing. In addition Manganese content of above 2% also deteriorates the weldability of the present steel and ductility targets may not be achieved.

Silicon content of the composite coil of steel of present invention is between 0.4% and 2%. Silicon is a constituent that can retard the precipitation of carbides during overaging, therefore, due to the presence of Silicon, Carbon rich Austenite is stabilized at room temperature. Further due to poor solubility of Silicon in carbide it effectively inhibits or retards the formation of carbides, hence, also promotes the formation of low density carbides in Bainitic structure which is sought as per the present invention to impart the Steel of present invention with its essential mechanical properties. However, a disproportionate content of Silicon does not produce the mentioned effect and leads to problems such as temper embrittlement. Therefore, the concentration is controlled within an upper limit of 2%.

Chromium content of the composite coil of steel of present invention is between 0.2% and 1%. Chromium is an essential element that provides strength and hardening to the steel but when used above 1% impairs the surface finish of steel. Further Chromium content under 1% coarsens the dispersion pattern of carbide in Bainitic structures, hence, keeps the density of Carbide low in Bainite.

The content of the Aluminum is between 0.01% and 1%. In the present invention Aluminum removes Oxygen existing in molten steel to prevent Oxygen from forming a gas phase during the solidification process. Aluminum also fixes Nitrogen in the steel to form Aluminum nitride so as to reduce the size of the grains. Higher content of Aluminum, above 1%, increases Ac3 point to a high temperature thereby lowering the productivity. Aluminum content between 0.8% and 1% can be used when high Manganese content is added in order to counterbalance the effect of Manganese on transformation points and Austenite formation evolution with temperature.

Sulfur is not an essential element but may be contained as an impurity in steel and from point of view of the present invention the Sulfur content is preferably as low as possible, but is 0.09% or less from the viewpoint of manufacturing cost. Further if higher Sulfur is present in steel it combines to form Sulfides especially with Manganese and reduces its beneficial impact on the present invention.

Phosphorus constituent of the Steel of the present invention is between 0.002% and 0.09%. Phosphorus reduces spot weldability and hot ductility, particularly due to its tendency to segregate at the grain boundaries or co-segregate with Manganese. For these reasons, its content is limited to 0.09% and preferably lower than 0.06%.

Nitrogen is limited to 0.09% in order to avoid ageing of material and to minimize the precipitation of Aluminum nitrides during solidification which are detrimental for mechanical properties of the steel.

Nickel may be added as an optional element in an amount of 0% to 1% to increase the strength of the composite coil of steel and to improve its toughness. A minimum of 0.01% is required to get such effects. However, when its content is above 1%, Nickel causes ductility deterioration.

Copper may be added as an optional element in an amount of 0% to 1% to increase the strength of the composite coil of Steel and to improve its corrosion resistance. A minimum of 0.01% is required to get such effects. However, when its content is above 1%, it can degrade the surface aspects.

Molybdenum is an optional element that constitutes 0% to 0.1% of the Steel of present invention. Molybdenum plays an effective role in improving hardenability and hardness, delays the appearance of Bainite and avoids carbide precipitation in Bainite. However, the addition of Molybdenum excessively increases the cost of the addition of alloy elements, so that for economic reasons its content is limited to 0.1%.

Niobium is present in the Steel of the present invention between 0% and 0.1% and suitable for forming carbonitrides to impart strength of the Steel of the present invention by precipitation hardening. Niobium will also impact the size of microstructural components through its precipitation as carbo-nitrides and by retarding the recrystallization during heating process. Thus a finer microstructure formed at the end of the holding temperature and as a consequence after the complete annealing will lead to the hardening of the product. However, Niobium content above 0.1% is not economically interesting as a saturation effect of its influence is observed. This means that additional amount of Niobium does not result in any strength improvement of the product.

Titanium is added to the Steel of the present invention between 0% to 0.1%. As with Niobium, it is involved in carbo-nitrides so Titanium plays a role in hardening. But it is also forms Titanium-nitrides appearing during solidification of the cast product. The amount of Titanium is so limited to 0.1% to avoid the formation of coarse Titanium-nitrides detrimental for formability. Titanium content below 0.001% does not impart any effect on the steel of the present invention.

Calcium content in the steel of the present invention is between 0.001% and 0.005%. Calcium is added to steel of the present invention as an optional element especially during the inclusion treatment. Calcium contributes towards the refining of the Steel by arresting the detrimental Sulfur content in globular form thereby retarding the harmful effect of Sulfur.

Vanadium is effective in enhancing the strength of steel by forming carbides or carbo-nitrides and the upper limit is 0.1% from economic points of view. Other elements such as Cerium, Boron, Magnesium or Zirconium can be added individually or in combination in the following proportions: Cerium≤0.1%, Boron≤0.003%, Magnesium≤0.010% and Zirconium≤0.010%. Up to the maximum content levels indicated, these elements make it possible to refine the grain during solidification. The remainder of the composition of the steel consists of iron and inevitable impurities resulting from processing.

The composition of Stringer used by the steel of the present invention is as follows:

The first Stringer and the second stringer comprising of the following elements, expressed in percentage by weight 0.001%≤C≤0.25%; 0.2% Mn≤2%; 0.01%≤Si≤2%; 0.01%≤Cr≤1%; 0.01%≤Al≤1%; 0%≤S≤0.09%; 0%≤P≤0.09%; 0%≤N≤0.09%; and can contain one or more of the following optional elements 0%≤Ni≤1%; 0%≤Cu≤1%; 0%≤Mo≤0.1%; 0%≤Nb≤0.1%; 0%≤Ti≤0.1%; 0%≤V≤0.1%; 0.0015%≤B≤0.005%; 0%≤Sn≤0.1%; 0%≤Pb≤0.1%; 0%≤Sb≤0.1%; 0%≤Ca≤0.1%; the remainder composition being composed of iron and unavoidable impurities.

The composition of the prime steel comprising of the following elements, expressed in percentage by weight: 0.1%≤C≤0.4%; 0.2% Mn≤2%; 0.4%≤Si≤2%; 0.2%≤Cr≤1%; 0.01%≤Al≤1%; 0%≤S≤0.09%; 0%≤P≤0.09%; 0%≤N≤0.09%; and can contain one or more of the following optional elements 0%≤Ni≤1%; 0%≤Cu≤1%; 0%≤Mo≤0.1%; 0%≤Nb≤0.1%; 0%≤Ti≤0.1%; 0%≤V≤0.1%; 0.0015%≤B≤0.005%; 0%≤Sn≤0.1%; 0%≤Pb≤0.1%; 0%≤Sb≤0.1%; 0%≤Ca≤0.1%; the remainder composition being composed of iron and unavoidable impurities caused by processing The microstructure of the martensitic steel sheet comprises of:

Residual austenite and Bainite constituent cumulatively present in an amount between 0% and 25% and are optional constituents of present invention. Preferentially the amount of residual austenite and Bainite constituents is advantageous between 5% and 20%. Residual austenite imparts ductility and Bainite islands provide the strength to the steel of present invention.

Martensite constitutes 80% to 100% of microstructure by area fraction. Martensite can be formed when the composite coil of steel is cooled after annealing between 320° C. and 480° C. and may get tempered during the overaging holding done between temperature range between 320° C. and 480° C. Martensite imparts ductility and strength to the present invention.

The steel of the invention contains ferrite from traces to a maximum of 10%. Ferrite is not intended to be part of the invention but forms as a residual microstructure due to the processing of steel. The content of Ferrite must be kept as low as possible and must not exceed 10%. Up to a constituent percentage of 10% Ferrite imparts the steel of present invention with ductility but when the presence of ferrite exceeds 10% it may diminish the tensile strength of the composite coil of steel part.

In addition to the above-mentioned microstructure, the microstructure of the prime steel sheet is free from microstructural components such as pearlite and cementite.

EXAMPLES

The following tests, examples, figurative exemplification and tables which are presented herein are non-restricting in nature and must be considered for purposes of illustration only, and will display the advantageous features of the present invention.

Prime steel with different compositions is gathered in Table 1 and Table 1A shows the specifications of the prime steel sheet, stringer one and stringer two with their specific carbon content and tensile strengths before undergoing the continuous annealing, wherein the Table 2 shows annealing parameters performed on composite steel sheets. Thereafter Table 3 gathers the microstructures of the prime steel sheet obtained during the trials and table 4 gathers the result of evaluations of obtained weld properties of the composite coil as well as the mechanical properties achieved by the prime.

TABLE 1

| Prime Steel Sample | C | Mn | P | S | Si | Cr | Al | Nb | Ti | N | B | Ca |
|---|---|---|---|---|---|---|---|---|---|---|---|---|
| Sample 1 | 0.28 | 0.5 | 0.015 | 0.002 | 1.0 | 0.5 | 0.04 | 0.025 | 0 | 0.0063 | 0 | 0.0004 |
| Sample 2 | 0.28 | 0.5 | 0.015 | 0.002 | 1.0 | 0.5 | 0.04 | 0.025 | 0 | 0.0063 | 0 | 0.0004 |
| Sample 3 | 0.315 | 0.45 | 0.015 | 0.003 | 1.5 | 0.5 | 0.045 | 0.03 | 0.025 | 0 | 20 | 0 |
| Stringer Steel 1 | 0.17 | 0.38 | 0.009 | 0.0037 | 0.031 | 0.022 | 0.07 | 0.001 | 0.002 | 0.0049 | 0 | 0 |
| Stringer Steel 2 | 0.17 | 0.38 | 0.009 | 0.0037 | 0.031 | 0.022 | 0.07 | 0.001 | 0.002 | 0.0049 | 0 | 0 |

TABLE 1A

| Steel Sample | Trails | Prime Steel Carbon Content | Prime Steel Thickness | Prime Steel Tensile Strength Before Annealing | Stringer one Carbon Content | Stringer one Strength before Annealing | Stinger one thickness | Stringer two Carbon Content | Stringer two Strength before Annealing | Stinger two thickness |
|---|---|---|---|---|---|---|---|---|---|---|
| Sample 1 | I1 | 0.28 | 1.2 | 780 | 0.15 | 380 | 1.2 | 0.15 | 380 | 1.2 |
| Sample 2 | I2 | 0.28 | 1.6 | 780 | 0.15 | 380 | 1.6 | 0.15 | 380 | 1.6 |
| Sample 3 | I3 | 0.315 | 1.0 | 1027 | 0.15 | 380 | 1.0 | 0.15 | 380 | 1.0 |
| Sample 1 | R1 | 0.28 | 1.2 | 780 | 0.28 | 780 | 1.2 | 0.28 | 780 | 1.2 |
| Sample 2 | R2 | 0.28 | 1.6 | 780 | 0.28 | 780 | 1.6 | 0.28 | 780 | 1.6 |
| Sample 3 | R3 | 0.315 | 1.0 | 1027 | 0.315 | 1027 | 1.0 | 0.315 | 1027 | 1.0 |

according to the invention; R = reference; underlined values: not according to the invention.

Table 1A shows the tensile strength of the prime steel sheet and the stringer one and stringer two. Table 1A also mentions the carbon content and the thickness of the prime steel and stringers

TABLE 2

| Steel Sample | Trials | Average Heating temperature to soaking temperature (° C./s) | Annealing Soaking Temperature | Time of Soaking for Annealing (s) | Average Cooling rate after soaking temperature (° C./s) | Quenching Temperature | Overagging holding temperature | Overagging time | Ac3 (° C.) | Ms (° C.) |
|---|---|---|---|---|---|---|---|---|---|---|
| 1 | I1 | 3.5 | 880 | 170 | 2000 | 200 | 200 | 170 | 838 | 388 |
| 2 | I2 | 3.5 | 880 | 170 | 2000 | 200 | 200 | 170 | 838 | 388 |
| 3 | I3 | 4.5 | 910 | 170 | 2000 | 200 | 200 | 170 | 845 | 573 |
| 1 | R1 | 3.5 | 880 | 170 | 2000 | 200 | 200 | 170 | 838 | 388 |
| 2 | R2 | 3.5 | 880 | 170 | 2000 | 200 | 200 | 170 | 838 | 388 |
| 3 | R3 | 4.5 | 910 | 170 | 2000 | 200 | 200 | 170 | 845 | 573 |

I = according to the invention; R = reference; underlined values: not according to the invention.

Table 2 gathers the annealing process parameters implemented on composite coil to impart the prime steel of table 1 with requisite mechanical properties to become a martensitic steel. The Steel compositions 11 to 13 serve for the manufacture of martensitic steel sheet according to the invention. This table also specifies the reference steel sheet which are designated in table from R1 to R3. Table 2 also shows tabulation of Ms and Ac3. The Ms and Ac3 are defined for the inventive steels and reference steels as follows:

$$Ms\ (^\circ C.)=539-423C-30Mn-18Ni-12Cr-11Si-7Mo$$

$$Ac3=901-262*C-29*Mn+31*Si-12*Cr-155*Nb+86*Al$$

wherein the elements contents are expressed in weight percent.

The table 2 is as follows:

Table 3: The results of the various mechanical tests conducted in accordance to the standards are gathered. For testing the weld toughness, the Olsen cup test is performed in accordance of ASTM E643-15 and for testing the ultimate tensile strength and yield strength are tested in accordance of JIS-Z2241. Testing the weld bendability of the welded samples were subjected to bends over 5 inch and 10 inch radii with 15 alternate bending-unbending cycles after salt pot treatment. 15 alternate bending cycles were used because a continuous annealing cycle has at least 15 rolls that the strip must travel across.

TABLE 3

| Steel | | COMPOSITE COIL WELD PROPERTIES ESSENTIAL FOR CONDUCTING ANNEALING | | | PRIME STEEL MECHANICAL PROPERTIES AFTER ANNEALING | |
|---|---|---|---|---|---|---|
| Sample | Trials | Bendabilty | Weld Toughness (%) | Craks on the weld | UTS(MPa) | YS (MPa) |
| 1 | I1 | 15 | 80 | No | 1700 | 1200 |
| 2 | I2 | 15 | 72 | No | 1700 | 1200 |
| 3 | I3 | 15 | 85 | No | 2000 | 1200 |
| 1 | R1 | 10 | 55 | Yes | Not tested due to weld cracks | Not tested due to weld cracks |
| 2 | R2 | 8 | 45 | Yes | Not tested due to weld cracks | Not tested due to weld cracks |
| 3 | R3 | 2 | 30 | Yes | Not tested due to weld cracks | Not tested due to weld cracks |

I = according to the invention; R = reference; underlined values: not according to the invention.

Figure 6:
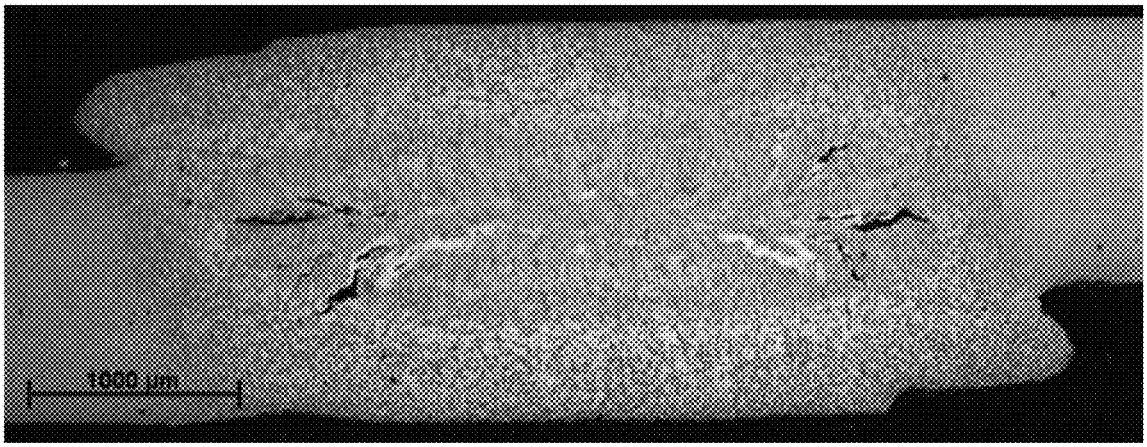
FIG. 6 shows the cracks developed during welding with a non-inventive stringer of R1.
Figure 7:
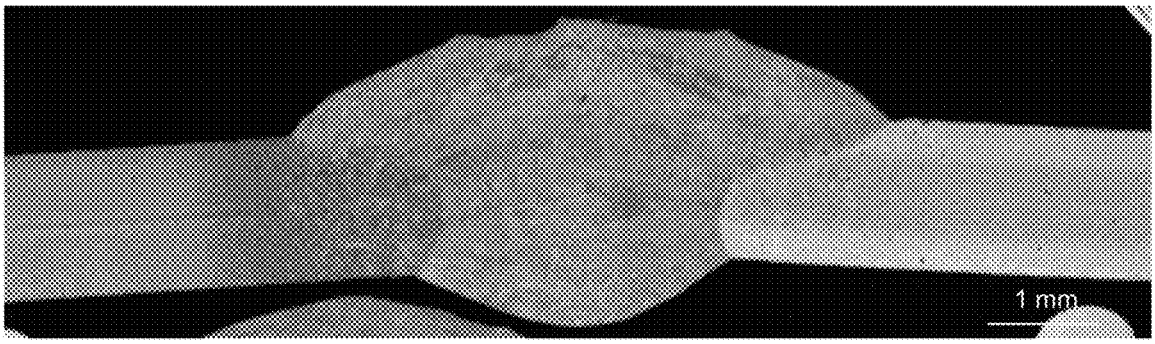
FIG. 7 shows the inventive example wherein no cracks develops.

Table 4 exemplifies the results of the tests conducted in accordance with the standards on different microscopes such as Scanning Electron Microscope for determining the microstructures of both the inventive and reference steels in terms of area fraction. Further for clearly elucidating the inventive feature of the method of the present invention FIG. 6 shows the cracks developed during welding of the stringer one on R1 and FIG. 7 shows the inventive example wherein no cracks develops.

The results are stipulated herein:

TABLE 4

| Steel Sample | Trials | Martensite (%) | Residual austenite + Bainite(%) | Ferrite (%) |
|---|---|---|---|---|
| 1 | I1 | 100 | 0 | 0 |
| 2 | I2 | 100 | 0 | 0 |
| 3 | I3 | 100 | 0 | 0 |
| 1 | R1 | None of the reference steel's microstructure was measured due the appearance of weld cracks | | |
| 2 | R2 | | | |
| 3 | R3 | | | |

I = according to the invention; R = reference; underlined values: not according to the invention.

The invention claimed is:

1. A method of manufacturing a composite coil comprising the following successive steps:

providing a prime steel in form of a non-heat treated cold rolled steel sheet;

de-coiling at least the first two outer windings of the non-heat treated cold rolled steel sheet;

preparing a leading end of the decoiled windings of the non-heat treated cold rolled steel sheet for welding;

welding a first stringer having carbon content less than the non-heat treated cold rolled steel sheet to the prepared end of the non-heat treated cold rolled steel sheet to define a welded cold rolled steel sheet;

spooling-back the welded cold rolled steel sheet to bring the un-welded end as the outer windings;

de-coil at least first two outer winds of the welded cold rolled steel sheet;

preparing the de-coiled end of welded cold rolled steel sheet for welding;

welding a second stringer steel having carbon content less than the non-heat treated cold rolled steel sheet to the de-coiled end of welded cold rolled sheet; and coiling the welded cold rolled steel sheet to obtain a composite coil;

where the prime steel comprises the following elements, expressed in percentage by weight:

$0.1\% \leq C \leq 0.4\%$;

$0.2\% \leq Mn \leq 2\%$;

$0.4\% \leq Si \leq 2\%$;

$0.2\% \leq Cr \leq 1\%$;

$0.01\% \leq Al \leq 1\%$;

$0\% \leq S \leq 0.09\%$;

$0\% \leq P \leq 0.09\%$;

$0\% \leq N \leq 0.09\%$;

And optionally one or more of the following elements:

$0\% \leq Ni \leq 1\%$;

$0\% \leq Cu \leq 1\%$;

$0\% \leq Mo \leq 0.1\%$;

$0\% \leq Nb \leq 0.1\%$;

$0\% \leq Ti \leq 0.1\%$;

$0\% \leq V \leq 0.1\%$;

$0.0015\% \leq B \leq 0.005\%$;

$0\% \leq Sn \leq 0.1\%$;

$0\% \leq Pb \leq 0.1\%$;

$0\% \leq Sb \leq 0.1\%$;

$0\% \leq Ca \leq 0.1\%$;

a remainder composition being composed of iron and unavoidable impurities caused by processing;

where the first stringer and the second stringer comprise the following elements, expressed in percentage by weight:

$0.001\% \leq C \leq 0.25\%$;

$0.2\% \leq Mn \leq 2\%$;

$0.01\% \leq Si \leq 2\%$;

$0.01\% \leq Cr \leq 1\%$;

$0.01\% \leq Al \leq 1\%$;

$0\% \leq S \leq 0.09\%$;

$0\% \leq P \leq 0.09\%$;

$0\% \leq N \leq 0.09\%$;

And optionally one or more of the following elements:

$0\% \leq Ni \leq 1\%$;

$0\% \leq Cu \leq 1\%$;

$0\% \leq Mo \leq 0.1\%$;

$0\% \leq Nb \leq 0.1\%$;

$0\% \leq Ti \leq 0.1\%$;

$0\% \leq V \leq 0.1\%$;

$0.0015\% \leq B \leq 0.005\%$;

$0\% \leq Sn \leq 0.1\%$;

$0\% \leq Pb \leq 0.1\%$;

$0\% \leq Sb \leq 0.1\%$;

$0\% \leq Ca \leq 0.1\%$;

a remainder composition being composed of iron and unavoidable impurities caused by processing.

2. The method as recited in claim 1 wherein the welding of the first and second stringers is performed by GMAW, TIG, MIG, Laser welding or arc welding.

3. The method as recited in claim 1 wherein a width of the first stringer, the second stringer and the non-heat treated cold rolled sheet is identical.

4. A composite coil manufactured according to the method recited in claim 1 wherein the composite coil comprises: the prime steel in form of the non-heat treated cold rolled steel sheet and the first and second stringers stringers.

5. A composite coil manufactured according to the method recited in claim 1 wherein welds of the composite coil have a weld toughness of more than 70%.

6. A composite coil manufactured according to the method recited in claim 1 wherein welds of the composite coil have weld bendability of more than 12 cycles or more.

7. A composite coil manufactured according to the method recited in claim 6 wherein the welds have a weld bendability of more than 14 cycles or more.

8. A method of manufacturing a martensitic steel having at least 70% of martensite and tensile strength more than 1500 MPa from a composite coil as recited in claim 4 comprising the following successive steps:

provide the composite coil as recited in claim 4;

then performing annealing by heating the composite coil at a rate greater than 2° C./s to a soaking temperature between Ac1 and Ac3+100° C. for a holding period of 10 seconds to 500 seconds;

then cooling the composite coil at a rate greater than 25° C./s to a temperature less than Ms temperature and holding the composite coil for a time between 10 and 1000 seconds in temperature range between 150° C. and 400° C.; and cooling the composite coil to room temperature and then performing a shear crop operation to remove the first stringer and second stringer to obtain martensitic steel sheet.

9. A martensitic steel manufactured according to the method as recited in claim 8, wherein the martensitic steel comprises the following elements, expressed in percentage by weight:

$0.1\% \leq C \leq 0.4\%$;

$0.2\% \leq Mn \leq 2\%$;

$0.4\% \leq Si \leq 2\%$;

$0.2\% \leq Cr \leq 1\%$;

$0.01\% \leq Al \leq 1\%$;

$0\% \leq S \leq 0.09\%$;

$0\% \leq P \leq 0.09\%$;

$0\% \leq N \leq 0.09\%$;

and optionally one or more of the following elements:

$0\% \leq Ni \leq 1\%$;

$0\% \leq Cu \leq 1\%$;

$0\% \leq Mo \leq 0.1\%$;

$0\% \leq Nb \leq 0.1\%$;

$0\% \leq Ti \leq 0.1\%$;

$0\% \leq V \leq 0.1\%$;

$0.0015\% \leq B \leq 0.005\%$;

$0\% \leq Sn \leq 0.1\%$;

$0\% \leq Pb \leq 0.1\%$;

$0\% \leq Sb \leq 0.1\%$;

$0\% \leq Ca \leq 0.1\%$;

a remainder composition being composed of iron and unavoidable impurities caused by processing, a microstructure of the steel by area percentage comprising a cumulative presence of residual austenite and bainite between 0% and 25%, a remaining microstructure being martensite at least 70%, and with an optional presence of ferrite between 0% and 10%.

10. The martensitic steel as recited in claim 9 wherein the composition has 0.4% to 1.8% of Silicon.

11. The martensitic steel as recited in claim 9 wherein the composition has 0.2% to 0.4% of Carbon.

12. The martensitic steel as recited in claim 9 wherein the composition has 0.01% to 0.5% of Aluminum.

13. The martensitic steel as recited in claim 9 wherein the composition has 0.2% to 1.5% of Manganese.

14. The martensitic steel as recited in claim 9 wherein the composition has 0.2% to 0.8% of Chromium.

15. The martensitic steel as recited in claim 9 wherein, the Martensite is more than or equal to 85%.

16. The martensitic steel as recited in claim 9 wherein the cumulative presence of residual austenite and bainite is between 1% and 10%.

17. The martensitic steel as recited in claim 9 wherein said sheet has an ultimate tensile strength of 1700 MPa or more, and a yield strength of 1000 MPa or more.

18. A method for manufacturing structural parts of a vehicle comprising the method as recited in claim 1.

19. A method for manufacturing structural parts of a vehicle comprising using the martensitic steel as recited in claim 9.

* * * * *